US010050328B2

(12) United States Patent
Rijssemus et al.

(10) Patent No.: US 10,050,328 B2
(45) Date of Patent: Aug. 14, 2018

(54) CABLE TAP

(71) Applicant: Technetix B.V., Veenendaal (NL)

(72) Inventors: Martien Rijssemus, Veenendaal (NL); Matthijs Laro, Veenendaal (NL)

(73) Assignee: Technetix B.V., Veenendaal (NL)

( * ) Notice: Subject to any disclaimer, the term of this patent is extended or adjusted under 35 U.S.C. 154(b) by 0 days.

(21) Appl. No.: 15/355,385

(22) Filed: Nov. 18, 2016

(65) Prior Publication Data

US 2017/0155182 A1 Jun. 1, 2017

(30) Foreign Application Priority Data

Nov. 27, 2015 (GB) ..... 1520975.2
Mar. 18, 2016 (GB) ..... 1604631.0

(51) Int. Cl.
*H01P 5/18* (2006.01)
*H01P 3/08* (2006.01)

(52) U.S. Cl.
CPC ..... *H01P 5/184* (2013.01); *H01P 5/18* (2013.01); *H01P 5/185* (2013.01)

(58) Field of Classification Search
CPC ..... H01P 5/18; H01P 3/08; H03H 7/48
USPC ..... 333/109, 112
See application file for complete search history.

(56) References Cited

U.S. PATENT DOCUMENTS 3,559,110 A * 1/1971 Wiley ..... H03H 7/48 333/112
4,222,066 A 9/1980 Zelenz
4,646,295 A * 2/1987 Basile ..... H04M 9/027 370/488
4,963,966 A 10/1990 Harney et al.
5,058,198 A * 10/1991 Rocci ..... H03H 7/482 333/100
5,485,630 A 1/1996 Lee et al.
H001858 H * 9/2000 Ibelings ..... 725/121
6,114,924 A * 9/2000 Cain ..... H03H 7/482 333/112
H001879 H 10/2000 Spriester et al.
(Continued)

FOREIGN PATENT DOCUMENTS

CN 201048432 Y 4/2008
CN 201104360 Y 8/2008
(Continued)

OTHER PUBLICATIONS

Espacenet, English Machine Translation of Abstract for CN201048432Y, dated Apr. 16, 2008, retrieved from https://worldwide.espacenet.com on Nov. 1, 2016 (1 page).
(Continued)

*Primary Examiner* — Dean Takaoka
(74) *Attorney, Agent, or Firm* — Wood Herron & Evans LLP

(57) ABSTRACT

There is provided a cable tap device for a CATV network comprising a microstrip directional coupler on an electrical path between an input and an output arranged to communicate with a splitter device associated with a plurality of tap ports. A ferrite core directional coupler is arranged in parallel with microstrip directional coupler with low frequency signals passing through ferrite core directional coupler and high frequency signals passing through the microstrip directional coupler.

7 Claims, 3 Drawing Sheets

(56) References Cited

U.S. PATENT DOCUMENTS

| | | | | |
|---|---|---|---|---|
| 6,560,778 | B1 * | 5/2003 | Hasegawa | H05K 9/0007 174/359 |
| 6,570,465 | B2 | 5/2003 | Tang | |
| 7,394,333 | B2 * | 7/2008 | Ezzeddine | H01P 5/186 333/109 |
| 8,587,387 | B2 * | 11/2013 | Lee | H01R 13/719 333/109 |
| 8,810,334 | B2 * | 8/2014 | Rijssemus | H04N 7/104 333/131 |
| 2002/0100060 | A1 | 7/2002 | Sugiura | |
| 2003/0093811 | A1 * | 5/2003 | Kaufman | H03H 7/48 725/128 |
| 2013/0061276 | A1 * | 3/2013 | Urban | H04N 7/106 725/109 |
| 2017/0155182 | A1 * | 6/2017 | Rijssemus | H01P 5/184 |
| 2017/0201001 | A1 * | 7/2017 | Boskaljon | H01P 5/184 |
| 2017/0264938 | A1 * | 9/2017 | Rijssemus | H04N 21/426 |

FOREIGN PATENT DOCUMENTS

| | | |
|---|---|---|
| EP | 0 821 527 A2 | 1/1998 |
| WO | 03/049225 A1 | 6/2003 |

OTHER PUBLICATIONS

Intellectual Property Office of the United Kingdom, Patents Act 1977: Search Report under Section 17, Application No. GB1604631.0, dated Sep. 7, 2016 (2 pages).

European Patent Office, International Search Report and Written Opinion of the International Searching Authority, International Application No. PCT/EP2015/063098, dated Sep. 28, 2015 (10 pages).

* cited by examiner

CABLE TAP

CROSS-REFERENCE TO RELATED APPLICATIONS

The present application claims priority under 35 U.S.C. § 119 of United Kingdom Patent Application No. 1520975.2, filed Nov. 27, 2015 and United Kingdom Patent Application No. 1604631.0, filed Mar. 18, 2016, the disclosures of which are hereby incorporated herein by reference in there entireties.

FIELD OF THE INVENTION

The present invention relates to a cable tap for a cable network, and, in particular, to an outdoor tap.

BACKGROUND OF THE INVENTION

Many cable networks are built in a cascaded (tree and branch) structure. This means that several amplifiers and taps are all placed in series with branches tapping off some of the signal and feeding again a cascade of amplifiers and taps. These branches can be tapped off to feed another cascade of taps. Since taps are placed in series and therefore have different input signal levels caused by attenuation in the coaxial cable and in the taps itself, different models of taps with different tap loss values are used. Usually, the first taps have a high input signal level and therefore need to have a high attenuation from input to tap output port, known as tap loss, and automatically a low insertion loss from the input to the output. When migrating down the line, the tap loss needs to be lower as there is less energy because of loss in the former taps and in the coaxial cable and the insertion loss becomes automatically higher as more energy is tapped off from the line.

These taps are known in the industry as "outdoor taps" as such a network is typically not mounted in cabinets but on overhead strands or poles or on the walls of houses.

In such a network, a small deviation from the ideal frequency response from in to out (so called ripple) in the outdoor taps is amplified by the total number of outdoor taps placed in series. This means that, for example, a small and seemingly unimportant ripple in the frequency response of 0.2 dB in a single outdoor tap is multiplied to a more significant 2 dB when 10 outdoor taps are cascaded. Since the outdoor taps usually have a more or less equal frequency response, this is a real problem.

The same is true for the insertion loss from in to out. If the insertion loss can be lowered with only as little as 0.1 dB this means that at the end of the coaxial line the level of insertion loss will be 0.1 dB×the number of cascaded outdoor taps higher. This is of great importance as many networks need to be stretched to higher frequencies to transport more and more data and programs. Higher frequencies mean significantly more loss in the coaxial cables and thus lower levels at the end of the line. Re-spacing or adding of amplifiers placed in the cascaded network is usually not possible or only at very high costs. A lower loss in the outdoor taps therefore is a real advantage.

SUMMARY OF THE INVENTION

In accordance with the present invention, there is provided a cable tap device for use in a cable television (CATV) network, comprising a first directional coupler and a second directional coupler arranged electrically in parallel between an input and an output, each directional coupler arranged to communicate with a common splitter device associated with a plurality of tap ports, wherein the first directional coupler is a microstrip directional coupler and the second directional coupler is a ferrite core directional coupler. By using a microstrip directional coupler and a ferrite core directional coupler in parallel, separate signal paths can be provided.

Capacitive elements may be associated with the microstrip directional coupler to prevent passage of low frequency signals through the microstrip directional coupler and, preferably, a separate capacitive element is associated with each of the input port, output port and coupled port of the microstrip directional coupler. In this way, the disadvantages of using a microstrip directional coupler for lower frequencies, typically below 400 MHz, can be avoided.

A coupling port of the microstrip directional coupler is preferably connected to an input port of the splitter device.

Capacitive and inductive elements may be associated with the ferrite core directional coupler to prevent passage of high frequency signals through the ferrite core directional coupler. Thus, the disadvantages of using a ferrite core directional coupler for higher frequencies, typically above 400 MHz, can be avoided.

Inductive elements associated with the ferrite core directional coupler are preferably air core inductors so to avoid hum modulation of the RF signal.

Signal modifying components such as attenuators or frequency dependent attenuators may be disposed in either or both of the signal path between the microstrip directional coupler and splitter device and the signal path between the ferrite core directional coupler and splitter device. This allows fine tuning of the signal characteristics of the cable tap.

BRIEF DESCRIPTION OF THE DRAWINGS

The present invention will now be described by way of example with reference to the following drawings in which.

DETAILED DESCRIPTION OF THE INVENTION

Figure 1:
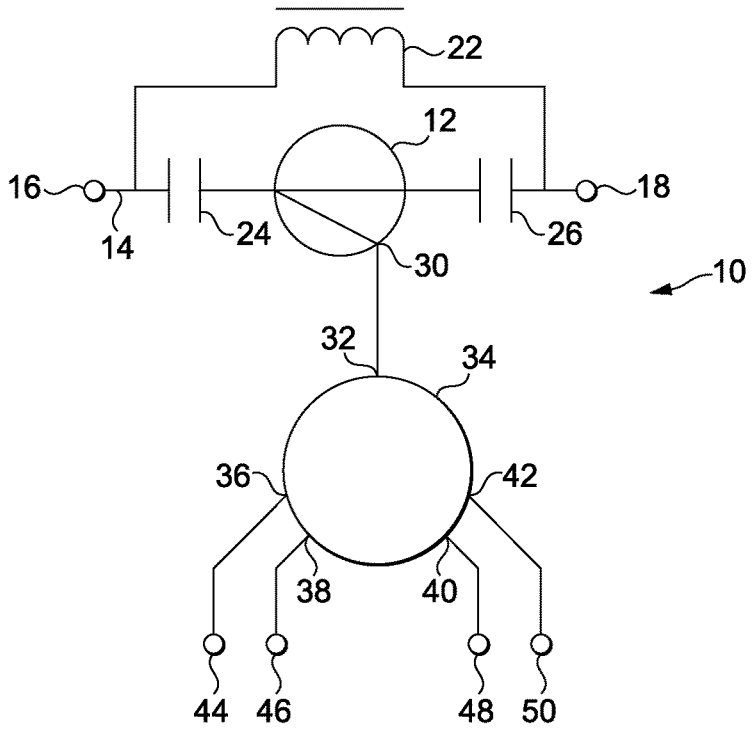
FIG. 1 PRIOR ART
FIG. 1 shows a schematic diagram of a prior art outdoor tap.

FIG. 1 shown an outdoor tap 10 as used in existing broadband cable television (CATV) networks. A plurality of interconnected taps is positioned between a headend associated with a cable provider and a plurality of downstream users, typically in a cascaded structure as described above.

Outdoor tap 10 as used in cascaded networks comprises a directional coupler 12 made from a ferrite core in the line 14 from in 16 to out 18, bypassed by a power choke 22 and capacitors 24, 26. The coupled port 30, also known as tap port, of ferrite core directional coupler 12 is connected typically to an input port 32 of a splitter 34 with the output ports 36, 38, 40, 42 of splitter 34 connected to output ports or connectors 44, 46, 48, 50 of outdoor tap 10. Splitter 34 can be of different architecture, for example, two way, three way, four way, six way or eight way depending on the needed number of user output ports on the outdoor tap.

Power choke 22 is required as these networks are powered using AC current of up to 10 Amp at 50 or 60 Hz passed along the coaxial cable and ferrite directional coupler 12 is not capable of carrying any significant AC or DC current. Power choke 22 is a large inductor and bridges the RF components in taps (and also in amplifiers). The power choke needs to be wideband as most cable networks use a frequency range of 5 MHz up to 1 GHz, needs to be capable of bypassing currents that can be as large as 10 Amps and also needs to have a low hum modulation at this current.

With the need to go to higher frequencies such as 5 MHz to 1200 MHz or even up to 1700 MHz, the design of the power chokes becomes more critical as the power choke itself becomes the limiting factor in the RF performance of the tap. Typically, power chokes introduce ripple in the frequency response at specific frequencies, insertion loss at higher frequencies and reduce the return loss.

Figure 2:
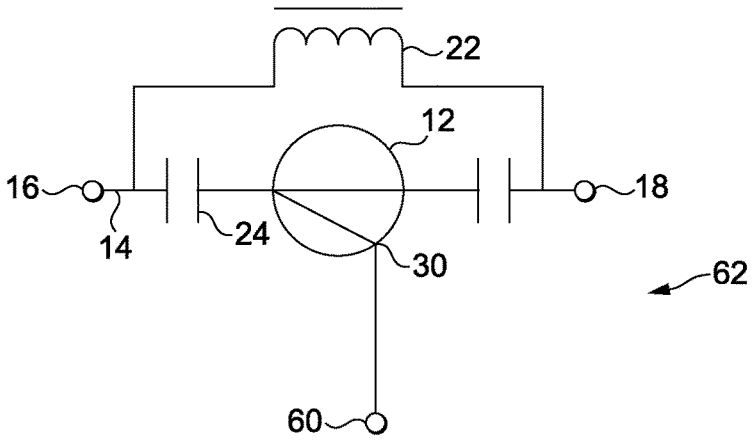
FIG. 2 PRIOR ART
FIG. 2 shows a schematic diagram of a prior art directional coupler.

As shown in FIG. 2, sometimes only one output 60 is needed and in the industry such an outdoor tap 62 is known as a directional coupler.

The ferrite core directional coupler has several inherent limitations:

It is not capable of carrying any significant AC or DC current and so a bypassing power choke is required in the outdoor tap. As described, this power choke is a limiting factor.

It is susceptible to DC or AC pulses as this changes the magnetic parameters of the ferrite and then the directional coupler will generate so called PIM products (Passive Inter-Modulation) with the RF levels typically found in cable networks.

A ferrite core directional coupler has significant added insertion loss compared to the theoretical value.

The ferrite core directional coupler needs to be aligned in the practical world to get the best performance.

It is difficult to get a good wideband RF performance as needed when cable networks migrate to, for example, 5 MHz to 1200 MHz or even 5 MHz to 1700 MHz.

In the practical world, the ferrite core directional coupler has a limit in the coupled value it can achieve. More than −16 dB coupled value is not possible to produce in the real world. This means that when an outdoor tap with a higher tap loss is needed this is achieved by adding an attenuator in the line from coupled port to the splitter or, in the event of a directional coupler, in the line to the output connector. The insertion loss from input to output of the outdoor tap however is still the same as a 16 dB ferrite core directional coupler.

The ferrite core directional coupler has a flat frequency response. This means that the tap loss, and also the insertion loss, is the same for all frequencies. However, the loss in the coaxial cable changes with the frequency, it is very low at low frequencies and quite high at high frequencies. Since the network is built with outdoor taps with different tap losses and the coaxial cable loss is very low at low frequencies, the actual loss in the complete network at low frequencies differs largely and depends on the tap output port.

This means that in the event of return path, the ingress (or noise) signals coming from the in-home installations are of equally different level. This is known in the industry as return path unbalance and it is very problematic as some in-home networks will limit the wanted received signals from other in-home installations. The ingress (or noise) level of the in-home installation connected to a low tap loss outdoor tap will be of much higher level and therefore dominant when added to wanted signals coming from an loss in-home installation connected to a high tap loss outdoor tap.

Figure 3:
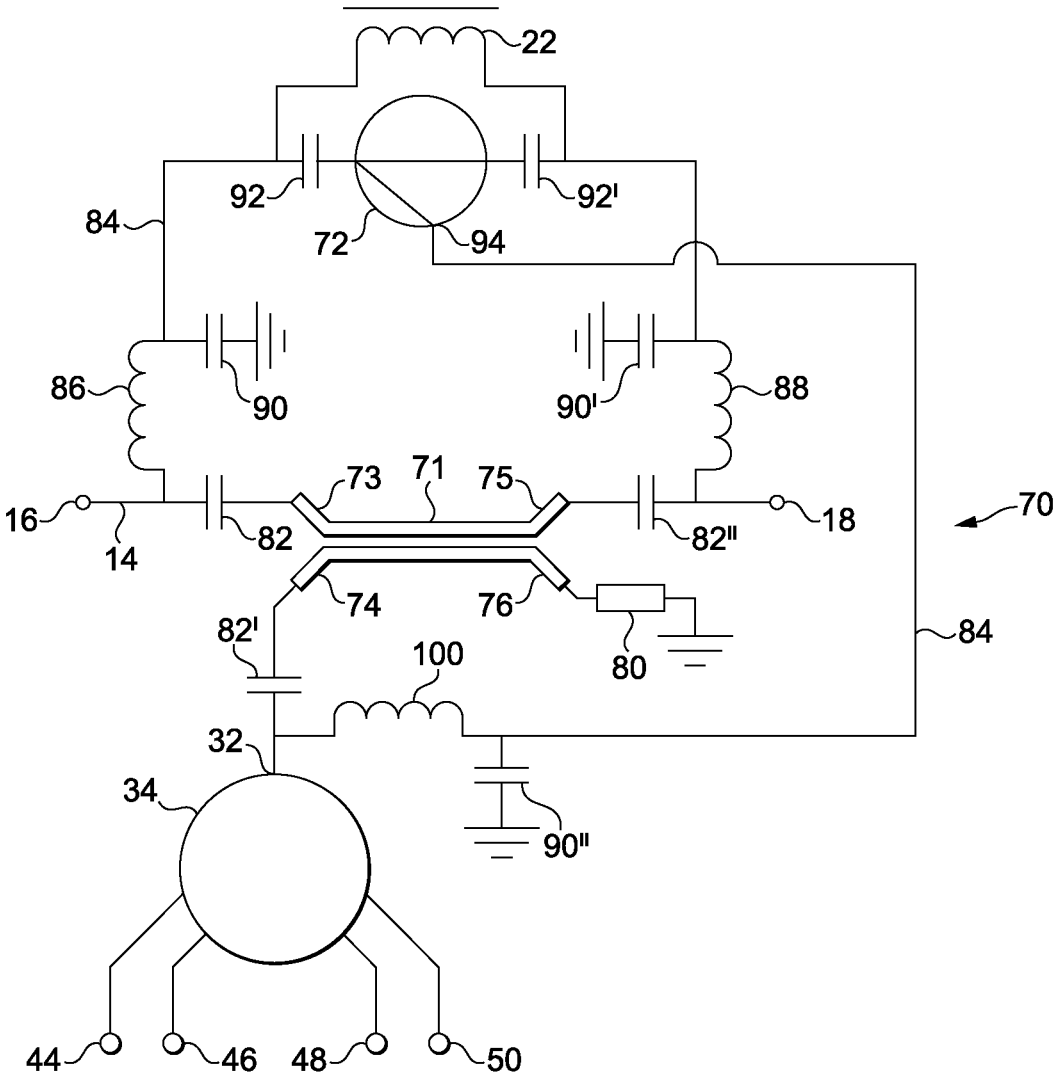
FIG. 3 shows a schematic diagram of a first embodiment of a cable tap.

To address the limitations of the ferrite core directional coupler, an embodiment of cable tap 70 in accordance with the present invention is shown in FIG. 3.

Outdoor tap 70 comprises a microstrip directional coupler 71 connected into path 14 passing from input 16 to output 18 so as to provide a high frequency signal path to tap splitter 34, with a ferrite core directional coupler 72 connected electrically in parallel to provide a low frequency signal path to tap splitter 34.

Microstrip directional coupler 71 has an input port 73 and an output port 75 connected between input 16 and output 18, with a coupled port 74 in two-way communication with four-way splitter 34 to supply signals to, and receive signals from, tap connector ports 44, 46, 48 and 50. Isolated port 76 of coupler 71 is connected to earth via resistor 80. Capacitors 82, 82' and 82" are attached respectively to input port 73, coupled port 74 and output port 75 so as to prevent low frequency signals travelling through the microstrip directional coupler in either the upstream or downstream direction.

For low frequency signals, an alternative signal path 84 is provided electrically in parallel with microstrip directional coupler 71, such that low frequency signals are routed through ferrite directional coupler 72 before reaching tap splitter 34. Signal path 84 is bi-directional allowing low frequency signals to pass from or to tap splitter 34.

Low frequency path 84 includes first and second inductive air cores 86, 88 disposed either side of ferrite directional coupler 72 associated with a power choke 22, with signals to ferrite directional coupler 72 routed from a main line between input 16 and output 18 to pass through inductive air cores 86, 88. Air cores 86, 88 are connected to earth via capacitors 90, 90' and capacitors 92, 92' are associated with ferrite directional coupler 72 to provide protection from AC or DC voltages.

Coupled port 94 of ferrite core directional coupler 72 is connected to tap splitter 34 with inductor 100 disposed between port 94 and tap 34. Signal path 84 connects into input port 32 of tap 34 beneath capacitor 82', such that capacitor 82' is disposed between coupled port 74 and the point where the high frequency and low frequency signal paths join.

The values of the inductive components, air cores 86 and 88 and inductor 100 and also the values of the capacitors 82, 82' 82", 90, 90', 90' are selected to ensure that low frequency signals of 400 MHz or below are routed through low frequency signal path 84 and prevented from passing into microstrip directional coupler 71 by capacitors 82, 82', 82". Higher frequencies above 400 MHz are not blocked by capacitors 82, 82', 82" and so high frequencies are free to travel through microstrip directional coupler 71 to reach tap ports 44, 46, 48 and 50. The circuit shown in FIG. 3 is bi-directional, separating high frequency signals from low frequency signals, routing high frequency signals through microstrip directional coupler 71 for both upstream and downstream signals, and routing low frequency signals upstream and downstream signals through ferrite core directional coupler 72.

At low frequencies, AC or DC voltage is blocked by capacitors 82, 82' 82" from microstrip directional coupler 71 and instead current travels through air core 86, power choke 22 and ferrite core directional coupler 72 to reach tap splitter 34.

The AC or DC current can be several amperes and using an air core inductor for each of the inductive elements 86, 88 avoids hum modulation of the RF signal.

There are many advantages of the proposed architecture of this hybrid tap when compared to an outdoor tap with a ferrite core directional coupler:

The microstrip directional coupler is not susceptible to AC or DC pulses, as it has no ferrite core, and has no Passive Intermodulation when used with the RF levels typically found in cable networks.

It has a very low insertion loss from input to output when compared to a ferrite core directional coupler.

It can be easily produced in higher coupled values and thus an outdoor tap constructed to the proposed architecture has an even lower insertion loss from input to output on the higher tap loss models.

There is no need to align as the coupled loss is defined by the lengths, widths and gap between the lines. These values can all be accurately fixed in production, hence there is a cost reduction.

In the proposed architecture a wideband response, for example, 5 MHz top 1200 MHz or 5 MHz to 1700 MHz, is much easier to achieve when compared to a ferrite core directional coupler.

In the proposed outdoor tap architecture, the tap loss at the return path can be the same for all models. Return path unbalance is no longer an issue. This results in much higher upstream data speeds.

It has a very low insertion loss for high frequencies associated with microstrip directional couplers, typically above 400 MHz from input to output when compared to a ferrite core directional coupler as shown in FIG. 1.

Since the low frequency response is created by the ferrite core directional coupler 72, the tap loss at low frequency is reduced.

The isolation tap to output at low frequencies is improved as the directivity of the ferrite core directional coupler is added to the tap loss resulting in higher isolation. There are no problems with ripple or micro reflection if the RF termination of the main line is not ideal.

The power choke is mounted in the low frequency path so the inherent high frequency problems of power chokes (loss, ripple typically for frequencies above 400 MHz) are avoided.

The arrangement shown in FIG. 3 provides high tap to output isolation and low tap loss associated with ferrite core directional couplers for lower frequencies below 400 MHz and for higher frequencies above 400 MHz provides the low insertion loss and cable compensating tap loss of associated with microstrip directional couplers.

Figure 4:
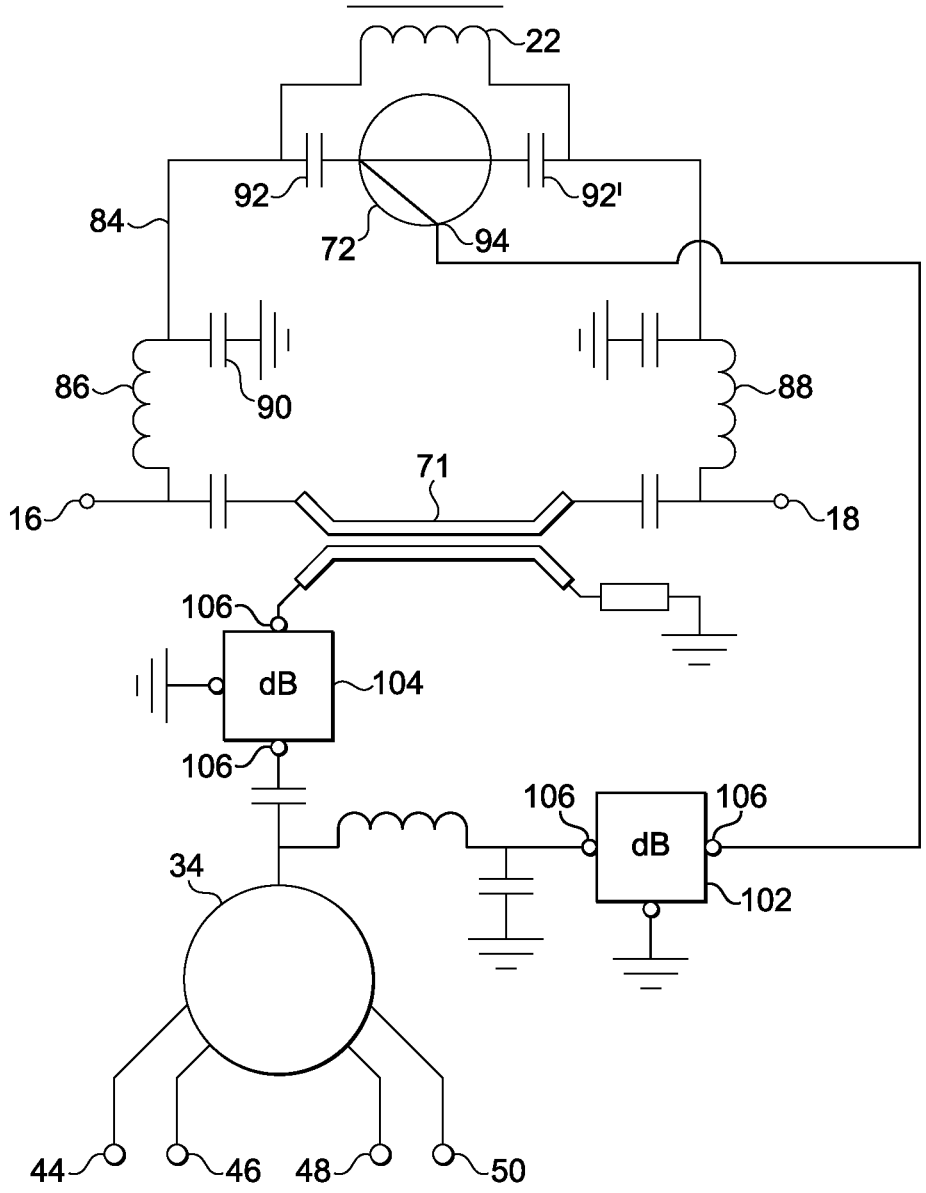
FIG. 4 shows a schematic diagram of a second embodiment.

An additional embodiment of a conditioned tap is shown in FIG. 4. Electrical components or electrical circuitry 102, 104 such as attenuators or frequency dependent attenuators can be disposed in the high frequency path between microstrip directional coupler 71 and four-way splitter 34 and alternatively or in combination disposed in the low frequency path between ferrite core directional coupler 72 and splitter 34. Electrical components 102, 104 allow fine-tuning of the signal characteristics of the cable tap to match the requirements of the network within which the cable tap is installed. Typically, plug-in connectors 106 are provided within the high and low frequency paths so that the electrical components or electrical circuitry 102, 104 can be added when needed, rather than being permanently hard wired.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A cable tap device, comprising:

a first directional coupler and a second directional coupler arranged electrically in parallel between an input and an output, each directional coupler arranged to communicate with a common splitter device associated with a plurality of tap ports, wherein the first directional coupler is a microstrip directional coupler and the second directional coupler is a ferrite core directional coupler and signal modifying elements are disposed in a signal path between the microstrip directional coupler and the splitter device.

2. The cable tap device according to claim 1, wherein capacitive elements are associated with the microstrip directional coupler to prevent passage of low frequency signals through the microstrip directional coupler.

3. The cable tap device according to claim 2, wherein a separate capacitive element is associated with each of an input port, output port and coupled port of the microstrip directional coupler.

4. The cable tap device according to claim 1, wherein a coupling port of the microstrip directional coupler is connected to an input port of the splitter device.

5. The cable tap device according to claim 1, wherein inductive and capacitive elements are associated with the ferrite core directional coupler to prevent passage of high frequency signals through the ferrite core directional coupler.

6. The cable tap device according to claim 5, wherein inductive elements associated with the ferrite core directional coupler are air core inductors.

7. The cable tap device according to claim 1, wherein signal modifying elements are disposed in a signal path between the ferrite core directional coupler and the splitter device.

* * * * *